US007810824B2

(12) United States Patent
Woodall et al.

(10) Patent No.: US 7,810,824 B2
(45) Date of Patent: Oct. 12, 2010

(54) SKATEBOARD DECK

(75) Inventors: Eben Woodall, Costa Mesa, CA (US); Chi Leung, Torrance, CA (US); Scott Jensen, Huntington Beach, CA (US)

(73) Assignee: Chomp, Inc., El Segundo, CA (US)

( * ) Notice: Subject to any disclaimer, the term of this patent is extended or adjusted under 35 U.S.C. 154(b) by 546 days.

(21) Appl. No.: 11/938,148

(22) Filed: Nov. 9, 2007

(65) Prior Publication Data

US 2008/0238013 A1 Oct. 2, 2008

Related U.S. Application Data

(60) Provisional application No. 60/879,862, filed on Jan. 10, 2007.

(51) Int. Cl.
*B62M 1/00* (2010.01)

(52) U.S. Cl. ..... 280/87.042; 280/87.041

(58) Field of Classification Search ..... 280/14.21, 280/14.22, 609, 610, 87.01, 87.021, 87.041, 280/87.042

See application file for complete search history.

(56) References Cited

U.S. PATENT DOCUMENTS

| | | | | |
|---|---|---|---|---|
| 4,182,520 | A | 1/1980 | Stevenson | |
| 4,295,656 | A | 10/1981 | Moore | |
| 4,921,513 | A | 5/1990 | Parten | |
| 5,165,710 | A * | 11/1992 | Runyon | 280/87.042 |
| 5,409,265 | A * | 4/1995 | Douglass | 280/843 |
| 5,591,509 | A | 1/1997 | Lorenz et al. | |
| 5,769,445 | A | 6/1998 | Morrow | |
| 6,105,991 | A * | 8/2000 | Dodge et al. | 280/610 |
| 6,182,986 | B1 | 2/2001 | Smith | |
| 6,386,561 | B1 | 5/2002 | Hanson | |
| 6,520,530 | B1 * | 2/2003 | Dodge et al. | 280/610 |
| 6,527,284 | B2 | 3/2003 | Bert | |
| 6,565,104 | B1 | 5/2003 | Colon | |
| 6,648,363 | B2 | 11/2003 | Gordon | |
| 7,275,755 | B2 | 10/2007 | Marion | |
| 7,347,431 | B2 | 3/2008 | Hill et al. | |

(Continued)

FOREIGN PATENT DOCUMENTS

CN 201040175 Y 3/2008

(Continued)

OTHER PUBLICATIONS

Haider, "Skateboard Science," *Transworld Skateboarding*, May 14, 2002.

(Continued)

*Primary Examiner*—J. Allen Shriver, II
*Assistant Examiner*—Vaughn T Coolman
(74) *Attorney, Agent, or Firm*—Knobbe, Martens, Olson & Bear, LLP

(57) ABSTRACT

A skateboard deck is formed of several layers pressed and bonded together. Apertures are formed through the bottom-most layers, and impact support members are arranged within the apertures. The impact support members are more rigid than the other portions of the skateboard deck, and provide localized impact support while allowing the remaining layers of the deck to retain their performance characteristics and feel while strengthening the most vulnerable areas of the deck.

28 Claims, 6 Drawing Sheets

U.S. PATENT DOCUMENTS

| | | | | |
|---|---|---|---|---|
| 7,410,181 | B2 | 8/2008 | Colon | |
| 7,494,140 | B2 | 2/2009 | Schmitt | |
| 7,506,880 | B2 * | 3/2009 | Burwell | 280/87.042 |
| 7,669,879 | B2 | 3/2010 | Dykema | |
| 7,735,844 | B2 * | 6/2010 | Gallo | 280/87.042 |
| 7,748,725 | B2 * | 7/2010 | Piumarta | 280/87.042 |
| 2002/0030338 | A1 | 3/2002 | Bert | |
| 2002/0064640 | A1 | 5/2002 | Renard et al. | |
| 2002/0185835 | A1 | 12/2002 | Wen | |
| 2003/0222420 | A1 | 12/2003 | Hadzicki et al. | |
| 2004/0084878 | A1 | 5/2004 | Adamczewski | |
| 2004/0100052 | A1 | 5/2004 | Chou | |
| 2004/0188967 | A1 | 9/2004 | Gallo | |
| 2004/0222609 | A1 | 11/2004 | Schmitt | |
| 2005/0115470 | A1 | 6/2005 | Schmitt | |
| 2005/0134013 | A1 | 6/2005 | Wright et al. | |
| 2006/0049596 | A1 | 3/2006 | Hill et al. | |
| 2006/0097469 | A1 | 5/2006 | Nosworthy et al. | |
| 2006/0103098 | A1 * | 5/2006 | Esposito et al. | 280/87.042 |
| 2007/0069492 | A1 | 3/2007 | Lin | |
| 2008/0036165 | A1 * | 2/2008 | Reinson | 280/87.042 |
| 2008/0231009 | A1 * | 9/2008 | Hill et al. | 280/87.042 |
| 2009/0108554 | A1 | 4/2009 | Boyle et al. | |
| 2009/0121447 | A1 | 5/2009 | Piumarta | |
| 2009/0181210 | A1 | 7/2009 | Burwell | |

FOREIGN PATENT DOCUMENTS

| | | |
|---|---|---|
| CN | 101637652 A | 2/2010 |
| WO | WO 00/29080 | 5/2000 |
| WO | WO 2008/086441 | 7/2008 |

OTHER PUBLICATIONS

Vuckovich, "Skateboards Diversify," *Transworld Skateboarding*, Feb. 29, 2000.

Element Skateboards Summer 2008 Catalog (pp. 1-4 and covers).

"Skateboards Built One At A Time By Skateboarders," www.libskates.com, accessed Aug. 18, 2004.

International Preliminary Report on Patentability (under Patent Cooperation Treaty) for International Application No. PCT/US2008/050669, report issued Jul. 14, 2009.

* cited by examiner

SKATEBOARD DECK

CROSS-REFERENCE TO RELATED APPLICATIONS

This application claims the benefit under 35 U.S.C. §119 (e) of U.S. Provisional Application No. 60/879,862, which was filed Jan. 10, 2007, the entire contents of which are hereby incorporated by reference.

BACKGROUND OF THE INVENTION

1. Field of the Invention

The present invention relates to a skateboard deck construction, and more particularly to a skateboard deck having a member that absorbs impact forces.

2. Description of the Related Art

Skateboard decks constructed from laminated wood are well known. Typically, such laminated decks are constructed of several sheets of wood glued and pressed together to form a desired shape. Such a skateboard deck typically includes first and second truck mount portions at which wheeled trucks are attached to the deck, typically via bolts or screws extending through mount holes formed through the deck. Although such skateboard decks have attained wide acceptance, they suffer from drawbacks in terms of strength, weight and durability.

Accordingly, efforts have been made to strengthen skateboard decks. Some such efforts employ using alternative materials and technologies, such as composite materials. However, skateboarders are familiar with the feel and performance characteristics of wooden decks, and many skateboarders prefer the feel of such decks to alternatives that may incorporate additional technologies. Also, some alternative deck technologies create problems of their own, and may in some cases substantially increase the cost and weight of associated skateboard decks.

SUMMARY OF THE INVENTION

Accordingly, there is a need in the art for a skateboard deck having the feel of a traditional wood deck, but having increased strength and durability without increasing weight.

Applicants have noted that wooden laminate skateboard decks are particularly vulnerable to wear and breakage along a zone or line generally adjacent the inner truck bolt holes, or the truck bolt holes closest to the center of the deck.

Accordingly, there is a need in the art for a skateboard deck that is reinforced in the area(s) in which the deck is particularly vulnerable to breakage.

In accordance with one embodiment, the present invention provides a skateboard deck comprising a plurality of layers of wood pressed and bonded together. A truck mount zone is adapted to receive a skateboard truck mounted thereon. An impact support member comprises a fiber-reinforced composite and has a generally ovoid shape. The impact support member is generally aligned with the truck mount zone, the impact support member radiating outwardly from the truck mount zone and terminating between the truck mount zone and an edge of the deck. The impact support member disperses impact forces.

In one such embodiment, the bottom-most layer of wood has an aperture which complements the impact support member, and the impact support member is disposed in the aperture. In another embodiment, a density of adhesive between the impact support member and the adjacent layer is greater than an average density of adhesive between layers in the skateboard deck. In a further embodiment, a density of adhesive between the bottom-most layer adjacent the aperture and the adjacent layer is greater than an average density of adhesive between layers in the skateboard deck.

In another embodiment, the impact support member is circular.

In a further embodiment, one of the layers comprises an aperture that complements the impact support member, and the impact support member is disposed in the aperture. In one such embodiment, the impact support member and the layer have substantially the same thickness, and the thickness is less than an average thickness of the other layers. In another such embodiment, the thickness is less than a thickness of each of the other layers. In a further embodiment, the aperture and impact support member are disposed in the bottom-most layer of the deck.

In yet another embodiment, at least two adjacent layers each comprise an aperture, the apertures being substantially aligned, and an impact support member fits complementarily within the aligned apertures.

In accordance with another embodiment, the present invention provides a method of making a skateboard, comprising providing a plurality of layers of wood, providing an impact support member comprising a fiber-reinforced composite having a generally ovoid shape, pressing and bonding the wood layers together to form a deck, designating a truck mount zone adapted to receive a skateboard truck mounted thereon, and arranging the impact support member on the deck and generally aligned with the truck mount zone, the impact support member radiating outwardly from the truck mount zone to a terminus between the truck mount zone and an edge of the deck. The impact support member disperses impact forces.

One embodiment additionally comprises forming an aperture through one of the layers of wood, the aperture shaped and sized to complement the impact support member, and arranging the impact support member in the aperture. Another embodiment comprises applying an adhesive between layers of the skateboard deck, and a density of adhesive applied between the layer having the aperture and an adjacent layer is greater in an area adjacent the aperture than between an average density of adhesive between layers throughout the skateboard. In one such embodiment, a density of adhesive applied between a face of the impact support member and an adjacent layer is greater than an average density of adhesive between layers throughout the skateboard.

Another embodiment additionally comprises placing the layer having the aperture in the bottom-most position of the layers making up the skateboard deck. In one such embodiment, the bottom-most layer and the impact support member have substantially the same thickness, and the thickness is less than an average thickness of the layers in the skateboard deck.

In another embodiment, the impact support layer comprises a fiber-reinforced composite, and the method additionally comprises curing the impact support member prior to arranging the impact support member in the aperture.

In still another embodiment, the impact support layer is bonded to a bottom surface of the skateboard deck.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the embodiments summarized above are intended to be within the scope of the invention herein disclosed. However, despite the foregoing discussion of certain embodiments, only the appended claims (and not the present summary) are intended to define the invention. The summarized embodiments, and other embodiments of the present invention, will become readily apparent to those skilled in the art from the following detailed description of the preferred embodiments having reference to the attached figures, the invention not being limited to any particular embodiment(s) disclosed.

DETAILED DESCRIPTION OF PREFERRED EMBODIMENTS

Figure 1:
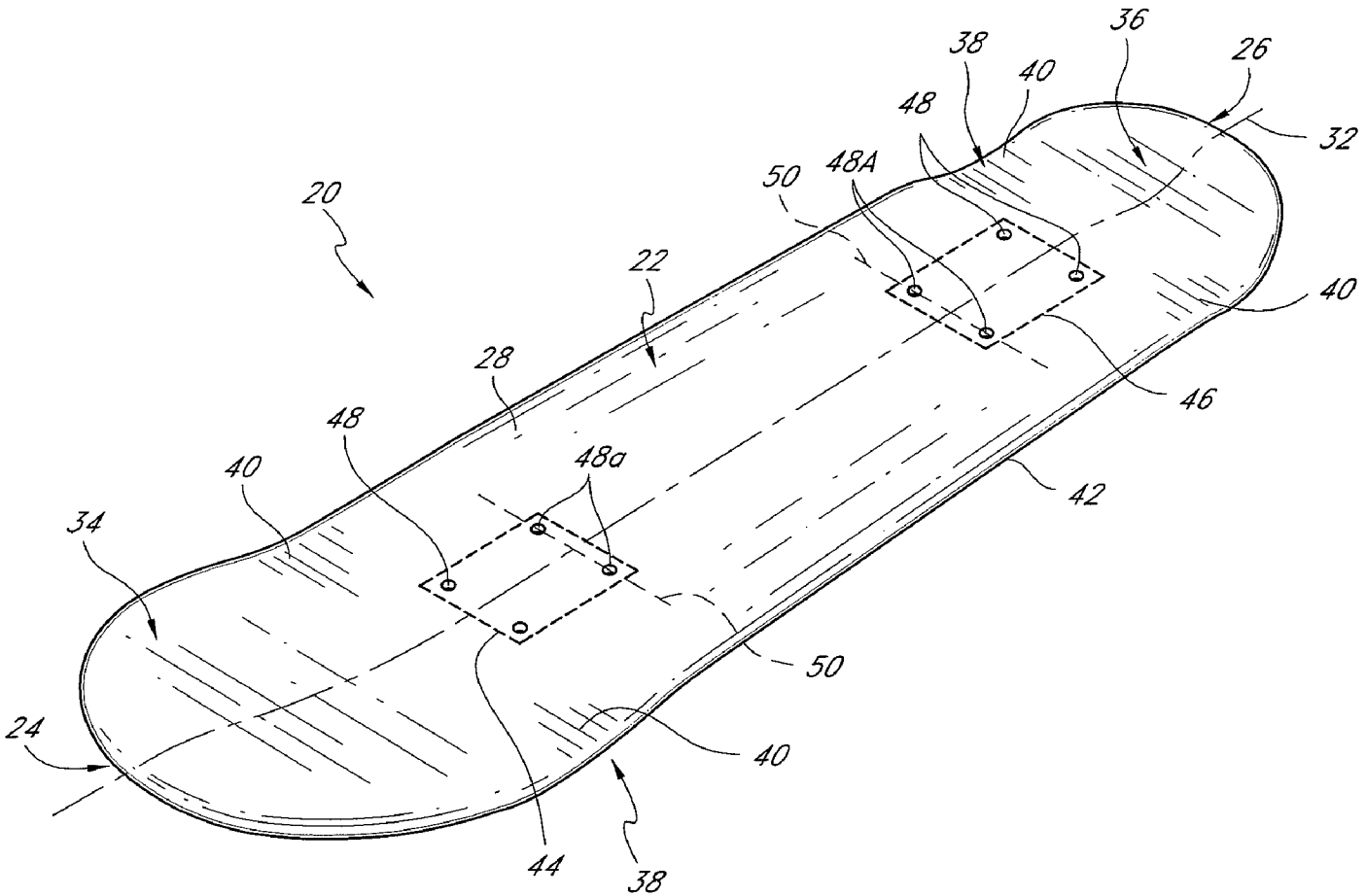
FIG. 1 is a perspective view of an assembled skateboard deck, showing truck mounting zones.

With initial reference to FIG. 1, an embodiment of a skateboard deck 20 is illustrated. The skateboard deck 20 has a planform shape approximating an elongated oval. The deck 20 comprises an elongate body 22 having first and second opposing ends 24, 26. Preferably, the skateboard deck 20 has a slightly concave upper surface 28 and a slightly convex lower surface 30 about a longitudinal axis 32 of the deck 20.

In the illustrated embodiment, a first tail 34 is formed adjacent the first end 24 and a second tail 36 is formed adjacent the second end 26. The first and second tail portions 34, 36 preferably are upturned, and there is a transition portion 38 between the body 22 and each upturned tail 34, 36. In each of the transition portions 38, hips 40 are formed generally along and adjacent an edge 42 of the skateboard deck 20 where the most dramatic change in curvature from the concave body 22 to the upturned tail 34, 36 occurs.

Such a skateboard deck 20 is typically configured to be attached to first and second wheeled trucks. As illustrated, first and second truck mount portions 44, 46 are indicated by phantom lines. The mount portions 44, 46 generally delineate an anticipated outline of the skateboard truck base plate 72 when such a truck would be attached to the bottom surface 30 of the deck 20. Typically, apertures 48 are formed through the deck 20 and generally approaching the corners of the truck mount portions 44, 46. Corresponding apertures typically are formed in the truck base plate. As such, bolts and/or screws extending through the mount holes 48 can secure the truck base plate 72 to the deck 20.

Applicants have noted that, during use, skateboard decks are particularly vulnerable to wear and breakage along a zone or line 50 generally at or adjacent the inner apertures 48A in each truck mount portion 34, 36. The inner apertures 48A are those generally closer to a middle portion of the deck 20 and also closest to the opposite truck mount. This vulnerability zone 50 demarcates a portion of the deck that is most likely to be exposed to the greatest stress concentrations during impacts and the like that can be expected during skateboarding, especially during high performance skateboarding in which the skateboarder becomes airborne and exerts great pressures when landing upon the deck.

The illustrated embodiment preferably comprises several layers of wood 55A-G glued and pressed together to form the skateboard deck 20. In a preferred embodiment, the skateboard deck 20 comprises seven layers 55A-G of North American hard maple wood, each layer being generally between about 0.04 and 0.07 inches thick, and more preferably between about 0.042 inches and 0.062 inches thick, resulting in an overall deck thickness between about 0.35 and 0.45 inches, or more preferably about 0.39 inches. Of course, different thickness ranges and different materials are contemplated.

Figure 2:
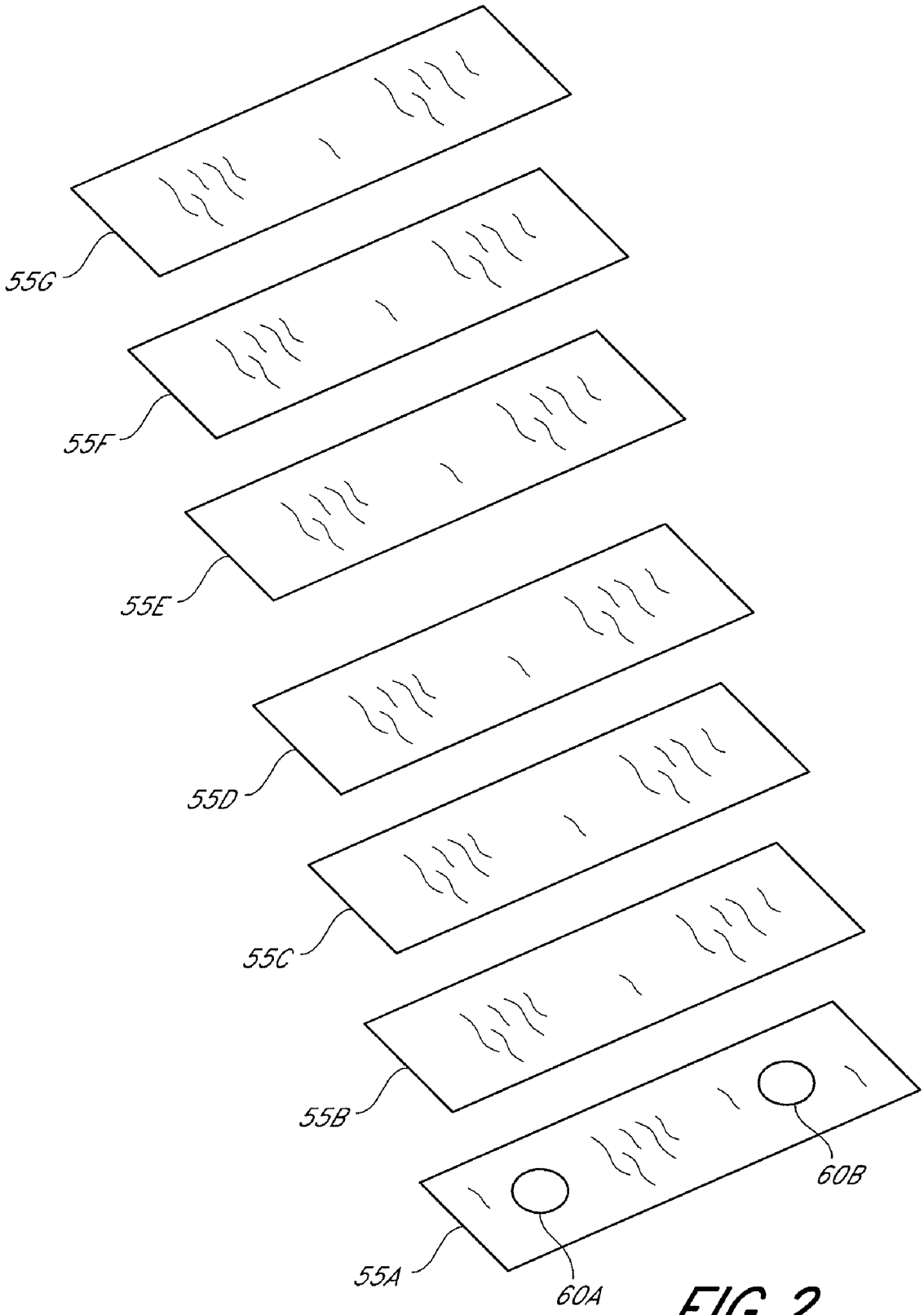
FIG. 2 is an exploded view showing layers to be assembled during a construction step of a skateboard deck embodiment.

To construct the illustrated skateboard deck 20 embodiment, the seven layers of wood 55A-G are arranged one on top of the other. FIG. 2 illustrates an exploded view of seven layers of wood 55A-G that are to be glued and pressed together to form an embodiment of a skateboard deck 20. In the illustrated embodiment, first and second apertures 60A, 60B are formed through the bottom-most layer 55A. The apertures 60 can be formed in any desired manner such as by boring, cutting, stamping, or the like. Preferably, the apertures 60 have an ovoid shape and, more preferably, the apertures 60 are circular. In the illustrated embodiment, the seven layers of wood 55A-G preferably are bonded together with an epoxy adhesive and, before the adhesive cures, inserted into a press having a mold in the press, the bonded wood layers take on the shape of the mold and the epoxy is cured sufficient so that the molded shape is retained when the bonded layers are removed from the mold. Once the skateboard deck 20 is removed from the mold, it is cut to the desired planform shape, and the truck mount apertures 48 preferably are bored.

Figure 3:
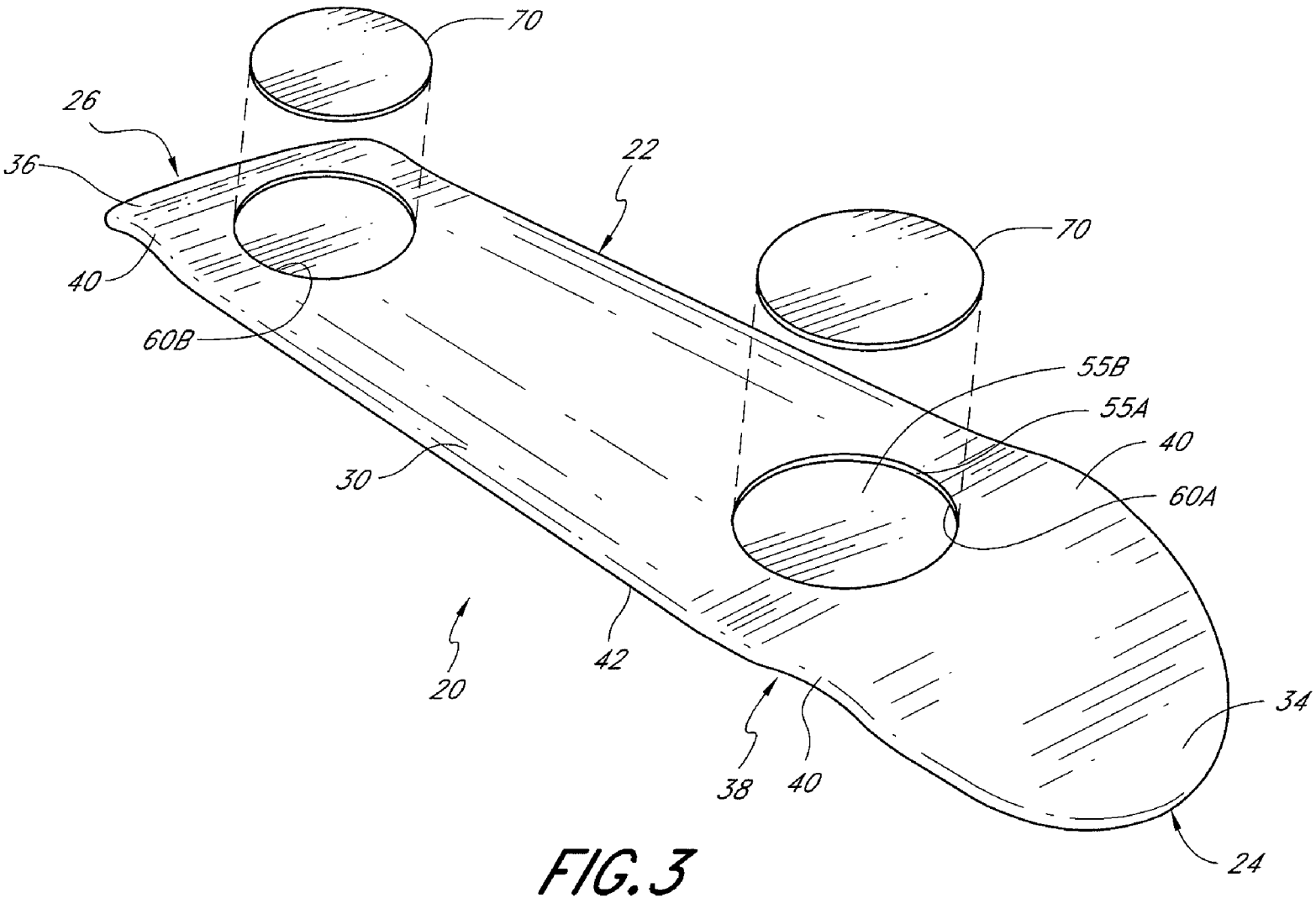
FIG. 3 is a partially exploded bottom perspective view of a skateboard deck embodiment having impact support members.

With additional reference to FIG. 3, in a preferred embodiment, rigid and resilient impact support members 70 are fit into the apertures 60 through the bottom-most layer of wood 55A. The impact support members 70 preferably are shaped to complement the apertures 60 formed in the bottom layer 55A. Preferably, the impact support members are made of a strong material, such as a fiber reinforced epoxy, a metal, or the like. In a preferred embodiment, the impact support members 70 are formed of carbon fiber material disposed in a cured epoxy matrix. Other types of fibers, such as aramid (Kevlar™) or glass, are also contemplated.

As indicated in FIG. 3, the carbon fiber impact support members 70 preferably have a thickness generally the same as a thickness of the bottom wood layer 55A of the skateboard deck 20. As such, preferably the bottom faces of the support members 70 are substantially flush with the bottom face of the bottom wood layer 55A, and the overall thickness of the deck in the area of the support members 70 is about the same as the overall or average thickness of the deck. Also, the impact support members 70 have an ovoid shape that generally avoids creating substantial stress concentrations.

FIG. 3 illustrates the impact support members 70 being fit into the apertures 60 of the bottom-most wood layer 55A. In one embodiment, the impact support members 70 are placed in the apertures 60 after the rest of the skateboard deck layers 55 have been bonded, pressed, and molded into the desired skateboard shape. However, in a more preferred embodiment, the impact support members 70 are placed within the apertures 60 in the bottom-most wood layer 55A when the other layers 55 are assembled and bonded together. Thus, the entire skateboard deck 20, including the impact support members 70, is placed together within the mold and pressed and cured simultaneously. As such, the impact support members 70 are tightly and unitarily bonded with the rest of the skateboard deck 20 layers, and the impact support members 70 take on the curved shape of the rest of the skateboard deck 20. Still further, preferably the impact support members 70 fit substantially flush with the bottom surface 30 of the bottom-most wood layer 55A.

In a preferred embodiment, carbon fiber impact support members are cured prior to being inserted into the skateboard deck 20. For example, in one embodiment, a flat carbon fiber sheet having the desired thickness is laid up and cured. A plurality of impact support members 70 are then cut out of the sheet such as by a die cutting method. Thus, the rigid and cured impact support members are substantially finished when inserted into the skateboard deck 20 apertures 60 during the construction process. Nevertheless, the cured impact support members still take on the desired shape when glued and molded in the press.

In another embodiment, a plurality of layers of a carbon fiber prepreg material is cut into a desired impact support member shape but not cured. During the skateboard deck 20 construction process the uncured impact support member is placed in the apertures. The impact support members are thus cured along with the epoxy that glues the wood layers and impact support members together into a unitary skateboard deck 20.

In a preferred embodiment, during construction of the deck, epoxy is supplied between each layer of wood 55 and between the impact support members 70 and the adjacent wood layer 55B. Preferably, distribution of epoxy throughout the deck 20 is generally consistent, except that an increased volume of epoxy is applied not only to a face of the impact support member 70 itself but also to the wood layers 55A, 55B in the area surrounding and adjacent each aperture 60 into which an impact support member 70 is placed. The increased density of epoxy in these areas more thoroughly ensures advantageous bonding of the impact support member 70 with the surrounding layers of wood 55B to protect against delaminations.

Although the impact support members are made of carbon fiber fabric in the illustrated embodiment, other materials and configurations of fibers and layers and materials can be used. Most preferably, however, the impact support members are constructed in a manner and using materials so as to be more rigid than the wood layers that make up the majority of the skateboard deck.

Additionally, during construction, preferably a face of the cured impact support member is sanded or otherwise roughened prior to the bonding process to eliminate glossy spots and improve adhesion of the support member to the adjacent layer of wood and to improve interaction with the epoxy glue.

Figure 4:
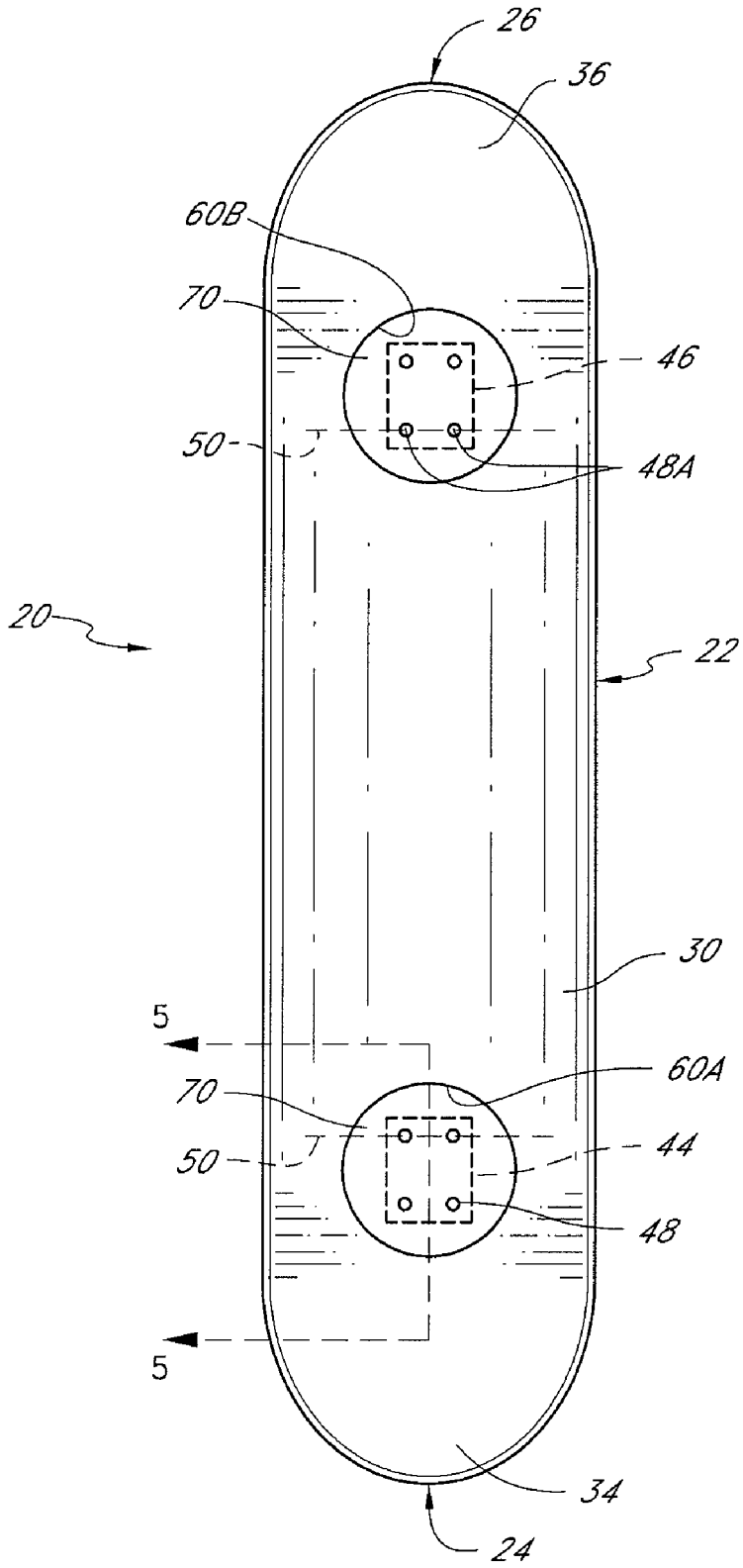
FIG. 4 is a bottom view of an assembled skateboard deck embodiment.
Figure 5:
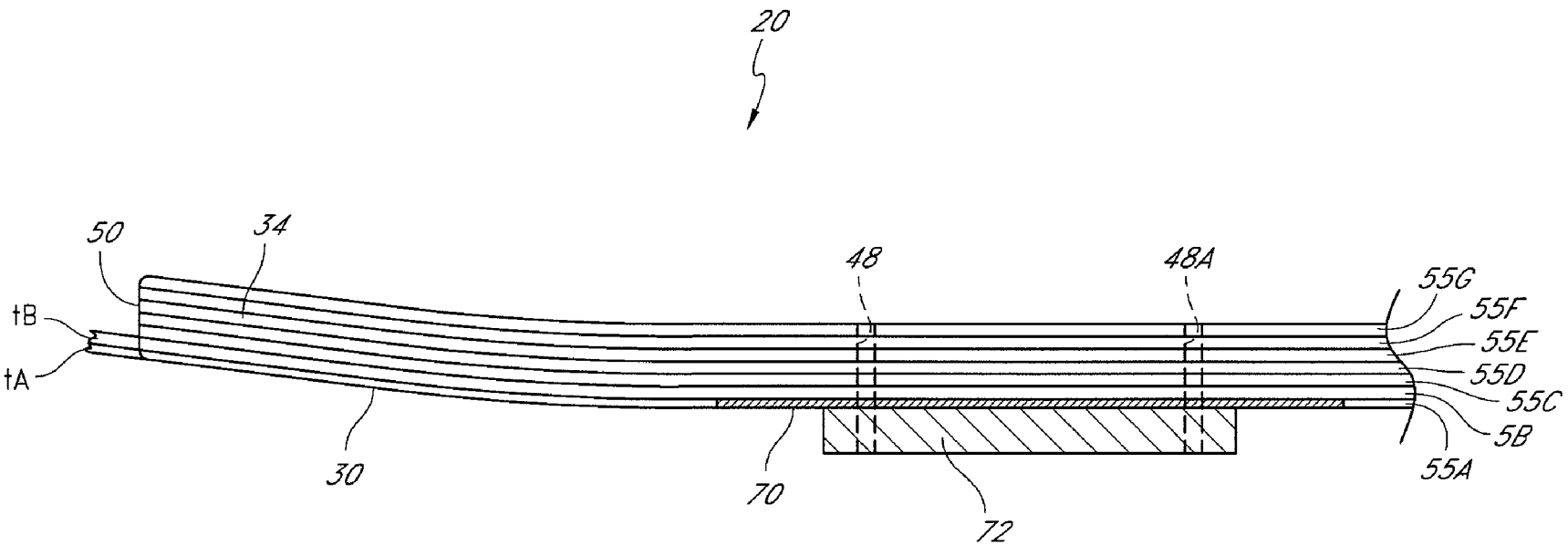
FIG. 5 is a partial cross sectional view of the skateboard deck of FIG. 4 taken along lines 5-5.
Figure 6:
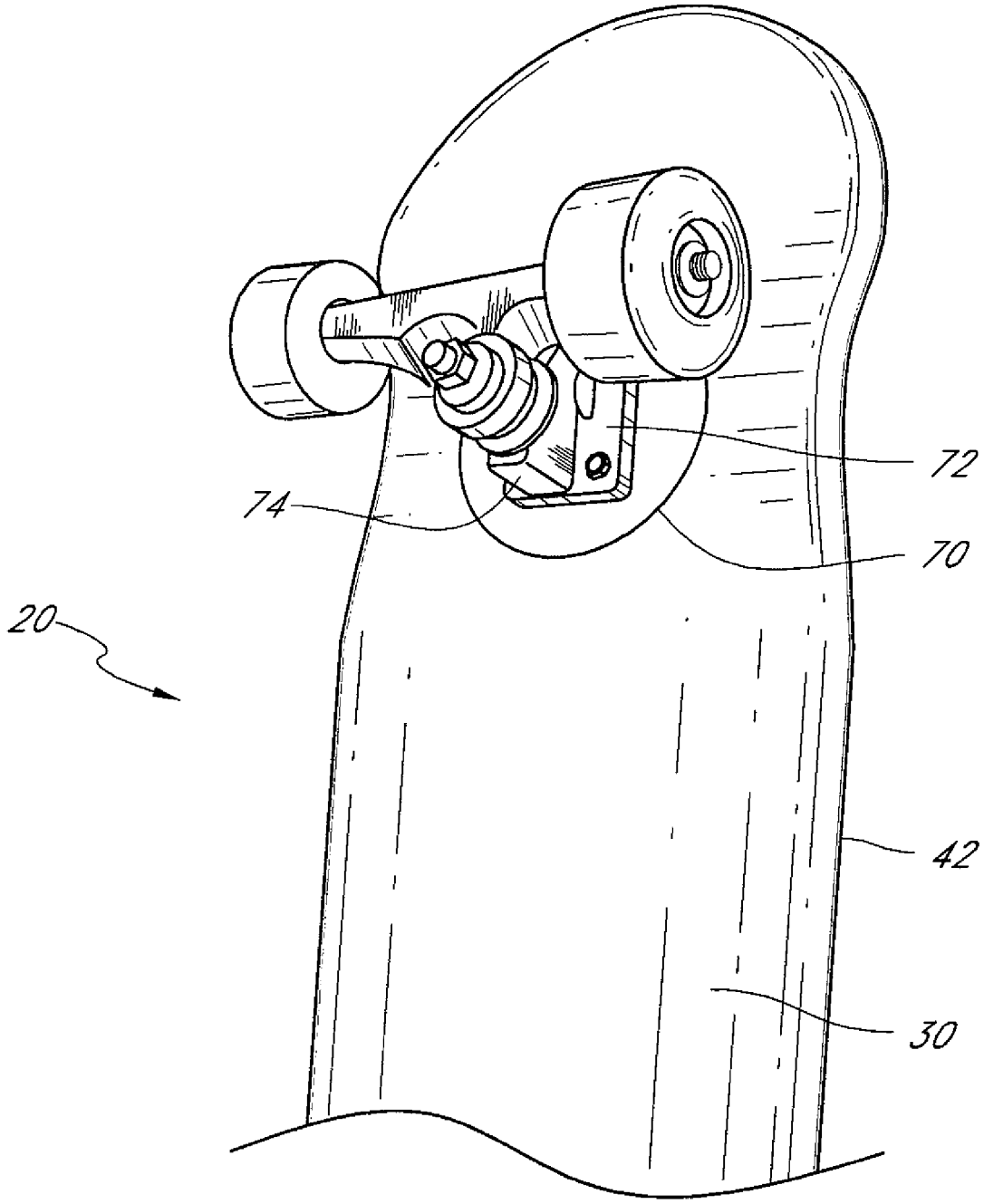
FIG. 6 is a partial bottom perspective view of the skateboard deck of FIG. 4 with a wheel and truck assembly attached.

With next reference to FIGS. 4-6, embodiments of a fully constructed skateboard deck 20 having impact support member 70 formed in the bottom-most layer 55A are illustrated. The truck mount portion 44 is shown in phantom lines on FIG. 4, and in FIG. 5 a representation of a skateboard truck base plate 72 is illustrated attached to the bottom of the skateboard deck 20. FIG. 6 shows an example in which a skateboard truck 74 is mounted onto the embodiment of FIG. 4. As shown, the impact support members 70 preferably are sized to cover the entire truck mount portion 44. Preferably the support members 70 extend or radiate outwardly beyond an anticipated footprint of a truck base plate 72. As such, the support member 70 extends through and across the typical vulnerability zone 30 in the deck 20, which extends as discussed above, generally across the inner truck mount apertures 48A.

As discussed above, preferably the impact support members 70 are more rigid than the surrounding wood layers 55A-G. As such, the impact support member 70 will dampen and disperse impact forces that otherwise would be focused on the most vulnerable portions 50 of the skateboard deck 20. Durability and breakage resistance of the deck thus are dramatically improved. Specifically, the portions in and around the truck mount zone 44, 46 and more specifically the vulnerability zone 50 around the inner truck mount apertures 48A.

Additionally, since the impact support members 70 are relatively small and unobtrusive, they have little, if any, effect on the overall performance and feel of the skateboard deck 20. More specifically, since the extra-rigid support members 70 are quite small, and limited in size to the area generally surrounding the truck mounts 44, 46, the predominantly wood deck 20 still behaves and feels like a traditional wooden deck. As such, durability is dramatically increased without substantially affecting the overall feel and performance of the skateboard deck 20.

With specific reference again to FIG. 5, in the illustrated embodiment, the bottom-most layer 55A of the skateboard deck 20 has a thickness tA that is less than a thickness tB of the adjacent wood layer 55B. In fact, in the illustrated embodiment, the bottom-most layer 55A is thinner than each of the other wooden layers 55B-G of the skateboard 20. In this embodiment, because of its increased strength, the impact support layer 70 can be made quite thin. Likewise, the bottom-most wood layer 55A can be made thinner than the other layers 55B-G of the skateboard, thus decreasing the overall weight and thickness of the skateboard 20 while still providing the increased strength and durability benefits of the impact support member.

In another embodiment, a skateboard deck can be constructed of wood layers of various thicknesses, including one or more very thin layers. However, preferably the bottom-most later, which includes the impact support members, has a thickness less than the average thickness of the other layers.

In yet another embodiment, the impact support members are disposed in an aperture formed in a wooden layer other than the bottom-most layer. As such, the support members are hidden from direct view, and completely enclosed within the wooden layers. However, most preferably the support members are disposed in the bottom-most layer so as to be closest to the interface of forces transferred between the truck mount base plate and the skateboard deck.

In still another embodiment, the impact support members have a thickness greater than the thickness of a single corresponding layer of wood. As such, apertures are formed through two or more adjacent layers of wood to accommodate the members.

In a still further embodiment, the impact support members are bonded to the bottom surface of the skateboard deck after the deck has been pressed and molded. Although the impact support member does not fit into an aperture in this embodiment, preferably it radiates outwardly beyond the truck mount zone but terminates short of the edge of the deck. In another embodiment having such construction, a thickness of one or more of the layers is reduced, or one or more layers are eliminated, so that the overall thickness of the skateboard deck including the impact support members is the same as or less than the thickness of a traditional wood skateboard.

In the illustrated embodiment, the impact support members 70 are circular. Such circular impact support members 70 are included in the class of ovoid shapes that also include, for example, an elongate oval. Impact support member 70 having ovoid shapes are contemplated by applicants. Applicants further contemplate even more shapes such as symmetrical and asymmetrical curvaceous shapes. Preferably, however, the impact support members 70 have shapes that avoid sharp edges that could create stress concentrations or more easily prompt delamination of the support member from the rest of the deck.

Additionally, although the illustrated skateboard deck has a particular shape, it is to be understood that skateboard decks having various shapes and sizes can employ the principles discussed herein. Also, although the illustrated deck is made of wood, impact support members can be used with decks comprising other materials, such as metal and plastic.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A skateboard deck, comprising:

a plurality of layers of wood pressed and bonded together so that a plurality of inner layers of wood are sandwiched between opposing outer layers of wood;

a truck mount zone adapted to receive a skateboard truck mounted thereon, the truck mount zone having a plurality of truck mount holes and being generally aligned with a profile of a portion of a skateboard truck as mounted on the deck, and an impact support member comprising a fiber-reinforced composite having a generally ovoid shape, the impact support member generally aligned with the truck mount zone and radiating outwardly from the truck mount zone and terminating between the truck mount zone and an edge of the deck;

wherein one of the outer layers of wood has an aperture which complements the impact support member, and the impact support member is disposed in the aperture;

wherein a volume per unit area of adhesive between the impact support member and the adjacent layer is greater than an average volume per unit area of adhesive between layers in the skateboard deck; and wherein the impact support member disperses impact forces.

2. The skateboard deck of claim 1, wherein the impact support member and the associated outer layer have substantially the same thickness, and the thickness is less than an average thickness of the other layers.

3. The skateboard deck of claim 2, wherein the aperture and impact support member are disposed in the bottom-most layer of the deck.

4. The skateboard deck of claim 3, wherein a bottom surface of the impact support member is generally flush with a bottom surface of the bottom-most layer of the deck.

5. The skateboard deck of claim 1, wherein the impact support member and the associated outer layer have substantially the same thickness, and the thickness is less than a thickness of each of the other layers.

6. The skateboard deck of claim 5, wherein the aperture and impact support member are disposed in the bottom-most layer of the deck.

7. The skateboard deck of claim 1, wherein the aperture is formed in the bottom-most layer of wood.

8. The skateboard deck in claim 7, wherein the impact support member is circular.

9. The skateboard deck of claim 1, wherein a volume per unit area of adhesive between the outer layer adjacent the aperture and the adjacent layer is greater than an average volume per unit area of adhesive between layers in the skateboard deck.

10. A skateboard deck, comprising:

an elongate body comprising a plurality of wood layers pressed and bonded together, the body having opposing first and second outer wood layers and inner wood layers between the outer wood layers, the body further having opposing first and second outer surfaces and a peripheral edge, the peripheral edge defined by aligned edges of the inner and outer wood layers, the first outer wood layer having a first surface that is unattached to any other layer;

a truck mount zone of the body defined to correspond to a profile of a mount portion of a skateboard truck adapted to be mounted on the body, a plurality of mount holes extending through the body in the truck mount zone, the holes spaced so as to correspond to holes formed in a mount portion of a skateboard truck;

an aperture formed through the first outer wood layer, the aperture sized and positioned so as to extend across the truck mount zone and to radiate outwardly from the truck mount zone to an aperture edge disposed between the truck mount zone and the peripheral edge of the body; and an impact support member comprising a fiber-reinforced composite layer, the impact support member being sized and configured to fit generally complementarily in the aperture so that the impact support member extends across the entire truck mount zone and radiates outwardly from the truck mount zone to the aperture edge, the impact support member being fit into the aperture, the first surface of the impact support member being unattached to any other layer;

wherein the elongate body first outer surface comprises the first surface of the impact support member and the first surface of the first outer wood layer.

11. The skateboard deck of claim 10, wherein the thickness of the fiber- reinforced composite layer is the same as or less than the thickness of each of the wood layers.

12. The skateboard deck of claim 11, wherein the impact support member is adhered to an adjacent inner wood layer, and a volume per unit area of adhesive between the impact support member and the adjacent inner wood layer in an area adjacent the aperture edge is greater than an average volume per unit area of adhesive between the wood layers in the skateboard deck.

13. The skateboard deck of claim 11, wherein the impact support member and the first outer wood layer have substantially the same thickness.

14. The skateboard deck of claim 10, wherein a thickness of the fiber-reinforced composite layer is less than an average thickness of each of the wood layers.

15. The skateboard deck of claim 10, wherein the impact support member and the first outer wood layer have substantially the same thickness.

16. The skateboard deck of claim 10, wherein the fiber-reinforced composite layer and the first outer wood layer have substantially the same thickness.

17. The skateboard deck of claim 10, wherein the first surface of the impact support member and the first surface of the first outer wood layer are substantially flush.

18. A skateboard deck, comprising:

an elongate body comprising a plurality of wood layers pressed and bonded together, the body having opposing first and second outermost wood layers and inner wood layers between the outermost wood layers, the body further having opposing first and second outermost surfaces and a peripheral edge, the peripheral edge defined by aligned edges of the inner and outermost wood layers, a first portion of the body first outermost surface being defined by the first outermost wood layer;

a truck mount zone of the body defined to correspond to a profile of a mount portion of a skateboard truck adapted to be mounted on the body, a plurality of mount holes extending through the body in the truck mount zone, the holes spaced so as to correspond to holes formed in a mount portion of a skateboard truck;

an aperture formed through a first one of the outermost wood layers, the aperture sized and positioned so as to extend across the truck mount zone and to radiate outwardly from the truck mount zone to an aperture edge disposed between the truck mount zone and the peripheral edge of the body; and an impact support member comprising a fiber-reinforced composite and being sized and configured to fit generally complementarily in the aperture so that the impact support member extends across the entire truck mount zone and radiates outwardly from the truck mount zone to the aperture edge, the impact support member being fit into the aperture so that a second portion of the body first outermost surface is defined by a first surface of the impact support member and so that an impact support member edge generally abuts the aperture edge and the first outermost wood layer is disposed between the impact support member edge and the peripheral edge of the body;

wherein the impact support member is adapted to reinforce the first outermost wood layer by absorbing and dispersing impact forces.

19. The skateboard deck of claim 18, wherein the first outermost wood layer has a first thickness, and the first thickness is less than an average thickness of the other wood layers.

20. The skateboard deck of claim 19, wherein adjacent layers are bonded together by an adhesive, and a volume per unit area of adhesive between the impact support member and the adjacent inner wood layer is greater than an average volume per unit area of adhesive between the wood layers in the skateboard deck.

21. The skateboard deck of claim 20, wherein a volume per unit area of adhesive between the first outermost wood layer and the adjacent inner wood layer in an area adjacent the aperture edge is greater than an average volume per unit area of adhesive between the wood layers in the skateboard deck.

22. The skateboard deck of claim 21, wherein the first outermost wood layer is the bottom-most layer of the skateboard deck.

23. The skateboard deck of claim 21, wherein a second truck mount zone is defined on the deck body, and the first outermost wood layer comprises a second aperture sized and positioned so as to extend across the second truck mount zone and to radiate outwardly from the second truck mount zone to a second aperture edge disposed between the second truck mount zone and the peripheral edge of the body, and a second impact support member is fit into the second aperture.

24. The skateboard deck of claim 18, wherein the skateboard deck has a curved shape in which the wood layers are curved to a desired shape, and the fiber-reinforced composite impact support member is cured in a shape corresponding to the curved skateboard deck.

25. The skateboard deck of claim 24, wherein the impact support member curved shape takes on a curvature of a non-planar portion of the skateboard deck adjacent the truck mount zone.

26. The skateboard deck of claim 18, wherein a second surface of the impact support member opposite the first surface of the impact support member is adhered to the inner wood layer immediately adjacent the first outermost wood layer, and the opposing first surface of the impact support member is generally flush with an outer surface of the first outermost wood layer so that the impact support member and first outermost wood layer define the body first outermost surface.

27. The skateboard deck of claim 18, wherein the first outermost wood layer has a first thickness, and the first thickness is less than a thickness of each of the other wood layers.

28. The skateboard deck of claim 18, wherein adjacent layers are bonded together by an adhesive, and a volume per unit area of adhesive between the impact support member and the adjacent inner wood layer is greater than an average volume per unit area of adhesive between the wood layers in the skateboard deck.

* * * * *